US006422161B2

(12) United States Patent
Koch

(10) Patent No.: US 6,422,161 B2
(45) **Date of Patent: *Jul. 23, 2002**

(54) COMBUSTION GRATE AND PROCESS FOR OPTIMIZING ITS OPERATION

(76) Inventor: Theodor Koch, Butzenstr. 20, 8304 Wallisellen (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/913,774

(22) PCT Filed: Mar. 12, 1996

(86) PCT No.: PCT/CH96/00092

§ 371 (c)(1),
(2), (4) Date: Jan. 8, 1998

(87) PCT Pub. No.: WO96/29544

PCT Pub. Date: Sep. 26, 1996

(30) Foreign Application Priority Data

Mar. 23, 1995 (CH) ..... 830/95

(51) Int. Cl.[7] ..... F23H 3/00; F28F 7/00

(52) U.S. Cl. ..... 110/299; 110/268; 165/81; 126/152 B; 126/167

(58) Field of Search ..... 126/152 B, 152 R, 126/163 R, 167, 174, 175; 110/268, 281, 291, 328, 298, 299, 300; 165/81

(56) References Cited

U.S. PATENT DOCUMENTS

| | | | | | |
|---|---|---|---|---|---|
| 498,686 | A | * | 5/1893 | Nye | 110/196 X |
| 1,354,531 | A | * | 10/1920 | Anthony | 126/152 R |
| 1,775,790 | A | * | 9/1930 | Tawlks | 126/163 R |
| 1,913,573 | A | * | 6/1933 | Turner | 165/81 |
| 3,247,897 | A | * | 4/1966 | Ammon | 165/81 |
| 4,026,247 | A | | 5/1977 | Jones | |
| 4,200,047 | A | * | 4/1980 | Knorr | 110/281 |
| 4,621,611 | A | * | 11/1986 | Koch | 126/174 |
| 5,086,714 | A | * | 2/1992 | Hladun | 110/281 |
| 5,142,999 | A | * | 9/1992 | Etemad et al. | 110/235 |
| 5,235,921 | A | * | 8/1993 | Dunham | 110/282 |
| 5,673,636 | A | * | 10/1997 | Stiefel | 110/346 |
| 5,680,824 | A | * | 10/1997 | Kemter et al. | 110/348 |
| 5,724,898 | A | * | 3/1998 | Von Bockh et al. | 110/291 |
| 5,775,238 | A | * | 7/1998 | Hauser | 110/282 |

FOREIGN PATENT DOCUMENTS

| | | | | |
|---|---|---|---|---|
| DE | 808263 | | 5/1951 | |
| DE | 93 09 198.2 | | 9/1993 | |
| FR | 739654 | | 1/1933 | |
| FR | 2463894 | * | 2/1981 | F23H/3/02 |
| GB | 1328348 | * | 8/1973 | 165/81 |
| JP | 55-110886 A | * | 8/1980 | 165/81 |
| JP | 59-95389 | * | 6/1984 | 165/81 |
| JP | 2106613 | | 4/1990 | |
| JP | 2000-146141 A | * | 5/2000 | F23H/11/18 |
| SE | 139436 | * | 3/1953 | 165/81 |
| SU | 1657867 A1 | * | 6/1991 | 110/298 |
| WO | 94/18502 | | 8/1994 | |
| WO | 95/21353 | | 8/1995 | |

* cited by examiner

*Primary Examiner*—Ljiljana Ciric
(74) *Attorney, Agent, or Firm*—Crowell & Moring LLP

(57) ABSTRACT

A combustion grate including fire bars which are either wholly or partially cooled by a fluid circulating in a closed regulating circuit. The flow lines which conduct the fluid have thermal expansion capability. In particular, windings are provided in the shape of a helical spring in these flow lines. The fire bars include corrugated exchangers and can be replaceable rods.

24 Claims, 6 Drawing Sheets

COMBUSTION GRATE AND PROCESS FOR OPTIMIZING ITS OPERATION

BACKGROUND AND SUMMARY OF THE INVENTION

This application claims the priority of Swiss application 830/95-6 and PCT/CH96/00092, the disclosures of which are expressly incorporated by reference herein.

The present invention relates to a combustion grate as well as to a method for optimizing the operation of a combustion grate.

It is known that combustion chambers can be used preferably for burning various fuels, such as household waste, industrial waste, wood waste, solid, porous, and liquid fuels as well as fuels with high and low ignition performance. Such known combustion chambers are typically composed of a mechanical grate and by cooled or uncooled fireproof side walls.

Systems of this kind have the disadvantage that their operation are not optimal for all fuels, and therefore certain parts of such systems, especially parts of the grate, suffer from defects and short service lives.

Systems for cooling grate coatings are already known such as cooling the grate surface by using the combustion air flowing past in the air horns or forced cooling of the grate surface by the combustion air, which is forced through a chamber formed by the fire bar and a conducting panel, into the combustion chamber.

These known types of cooling systems depend upon the volume of combustion air, and the air outlets in the combustion chamber can be clogged by ashes, solid metals, or slag. As a result, the cooling of the respective surface is no longer ensured. This can lead to problems. At the same time, these types of cooling systems suffer from the disadvantage that the volume of combustion air has a function that is related primarily to the technology of the process and is not required to perform a cooling function. Changing the volume of combustion air as a function of the cooling effect is not always feasible. In this case also, the cooling effect of the grate surface is not ensured.

Water cooling for the grate surface is also known. The volume of water intended for cooling the grate surface keeps the grate surface at an approximately constant temperature, independently of the heating value of the fuel. Once again, this is disadvantageous when burning fuels with a low heating value because the combustion chamber loses heat. In this case, a higher cast-surface temperature would be advantageous for combustion.

DE-U-93 09 198 discloses a combustion grate in which a liquid or gaseous medium can be conducted through the fire bars to control their temperature. Depending on the requirement, the grate can either be cooled or heated. The grate in this case has the general form of a board, in other words a largely plane external surface. Within the grate, baffles can be provided to form a labyrinth for the temperature-controlling medium.

It has been found, however, that problems regarding the expansion of the tempering medium occur as a result of the very high temperature fluctuations that occur, especially when a large number of fire bars are to have their temperatures controlled at the same time.

An object of the present invention is to provide an improved combustion grate and method to remedy this disadvantage and to ensure reliable temperature control to optimize fuel combustion.

To this end, the combustion grate according to the present invention and the method for its optimum operation utilize whole or partial cooling by both gas and fluid via a regulating circuit.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

The air/water-cooled combustion grate in FIGS. 1 to 7 is configured as a feed grate as far as its function is concerned. However, the present invention can be used as easily for other grate designs, such as a pyrolysis grate, degassing grate, gasification grate, combustion grate, high-temperature combustion grate, cooling grate, transport grate, countercurrent grate, opposing-feed grate, reversed-feed grate, roller grate, and the like.

Figure 1:
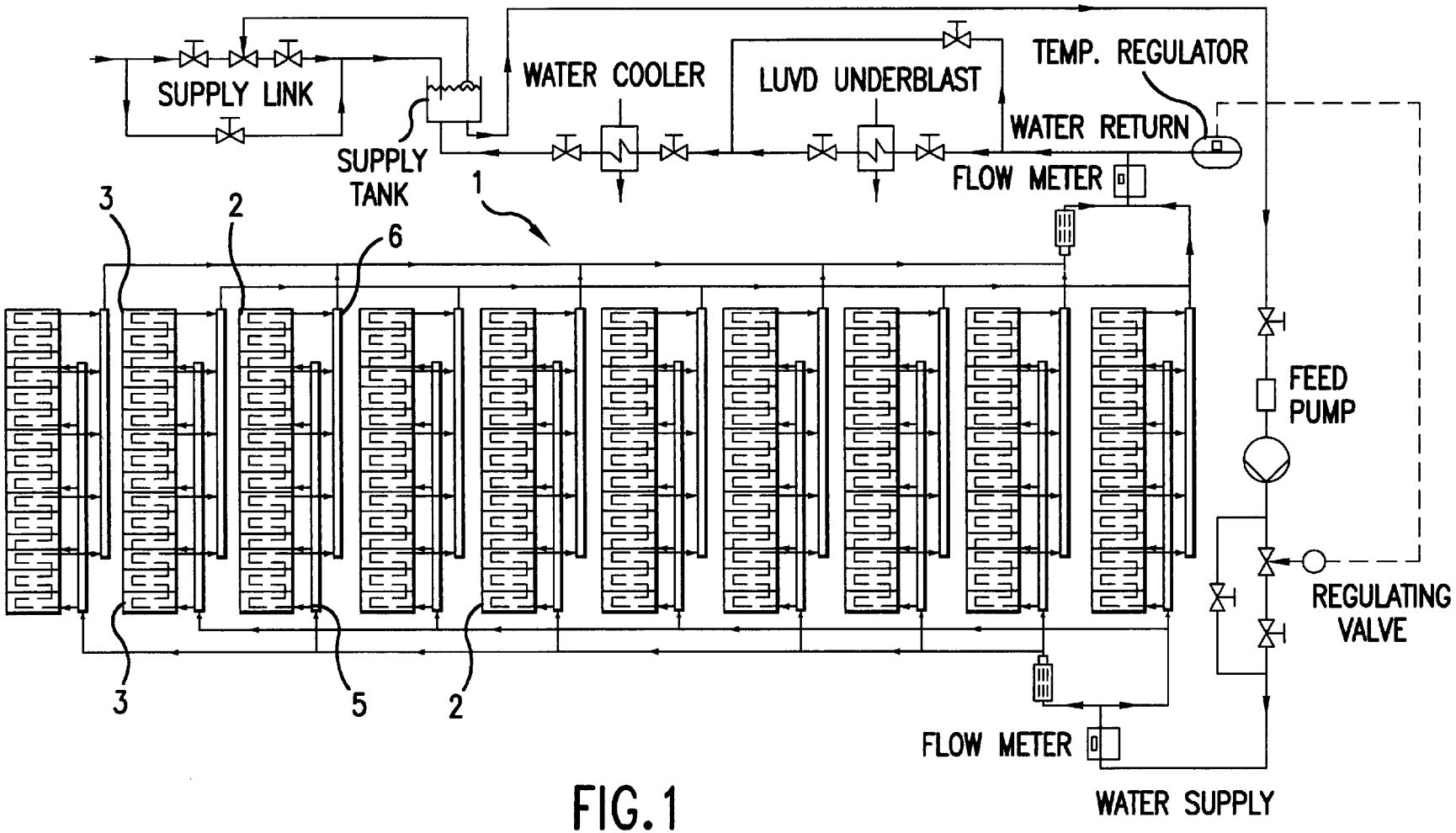
FIG. 1 is a cooling schematic view for an air/water-cooled combustion grate with a closed regulating circuit.

The feed grate 1 shown schematically in FIG. 1 serves to transport the fuel and the slag that results from combustion through the combustion chamber and simultaneously to function as a combustion air distribution device.

The grate consists of a plurality of zones arranged horizontally or at an angle. The individual zones can lie on the same plane or be separated by a drop.

Each individual grate zone consists of fixed and movable grate sections with fixed fire bars 3 and movable fire bars 2. The movable sections are moved forward and backward with a variable number of strokes, causing the fuel to be transported and consumed. The number of strokes depends on the fuel and the combustion process. Combustion takes place in the fuel layer, through which the combustion air, the so-called under-grate blast, is blown from below through gaps in grate surface 22 (FIG. 2) into the combustion chamber. The combustion air, which is effectively connected by a heat exchanger with the regulating circuit, simultaneously serves to cool the grate surface 22. The gaps between the individual fire bars 2 and 3 must be so small that as few unburned small particles fall through as possible. These gaps are all distributed uniformly over the entire grate surface.

The length of the strokes and the stroke speed of movable grate surface 22 of individual grate zones 20 is adjusted as a function of the heat generated on grate 1 and/or in the combustion chamber.

Grate surface 22 conveys the fuel through the combustion chamber.

Grate surface 22 serves as an air distribution device for the under-grate blast.

Grate surface 22 is subject to high thermal stress and, because of the high acquisition costs and long downtimes when repairs must be made, must have a long service life and high operating reliability.

The coolant for feed grate 1 is supplied through distributors 5, and after flowing through fire bars 2 and 3 is collected and returned in collectors 6. Water can be used as the coolant, as can fluids with high boiling points, for example certain oils, in particular. It is also possible, however, to use the closed regulating system shown in FIG. 1 to warm the coolant and thus cause it to give off heat to the grate as it flows through feed grate 1.

It is clear from the diagram of the cooling water in FIG. 1 that this water or the fluid flowing through the flow lines connected to the grate can be cooled or heated in a heat exchanger.

Another heat exchanger in the water network serves to heat or cool the under-grate blast. By mounting a temperature sensor or a temperature-measuring point, a desired temperature in the combustion chamber, especially the temperature of the under-grate blast, can be measured after it leaves grate 1. By appropriate regulation of the fluid medium flowing through the grate, the temperature of the under-grate blast can be raised or lowered, depending on the regulating program provided, which in particular must be adapted to the specific type of fuel.

In this manner, considerable advantage is obtained in that the through-flow medium can be used to change the under-grate blast temperature within the designated limits without the volume of under-grate blast being influenced thereby.

In the cooling water diagram shown in FIG. 1, the necessary through-flow fixtures are also provided to allow regulating parts to be bypassed and to disconnect them.

The flow of coolant is indicated by the corresponding arrows.

Figure 2:
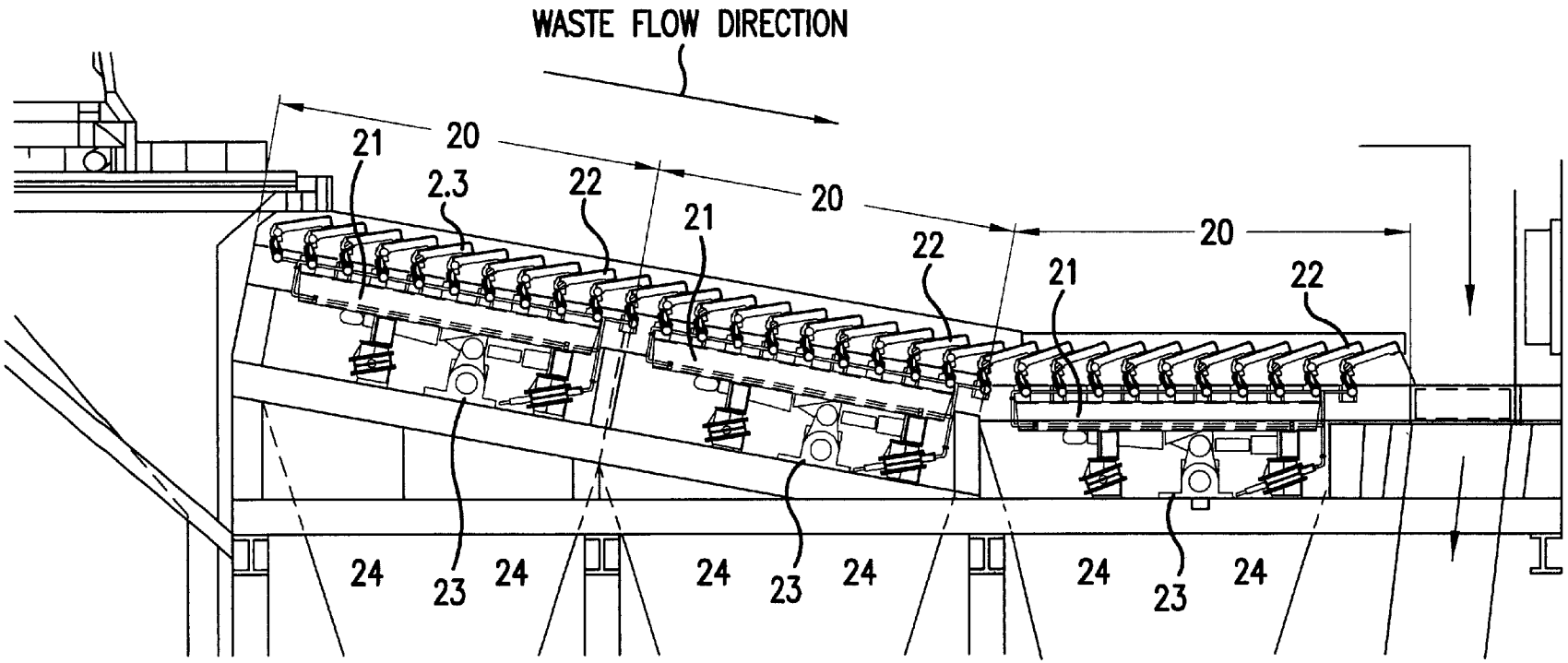
FIG. 2 is a side view of a feed grate.

FIG. 2 shows a feed grate 1 with three grate zones 20. Fire bars 2, 3 are mounted on grate carriages 21 and have a grate surface 22 that faces the combustion chamber. Air horns 23 are provided on the underside of feed grate 1 and define air zones 24.

Figure 3:
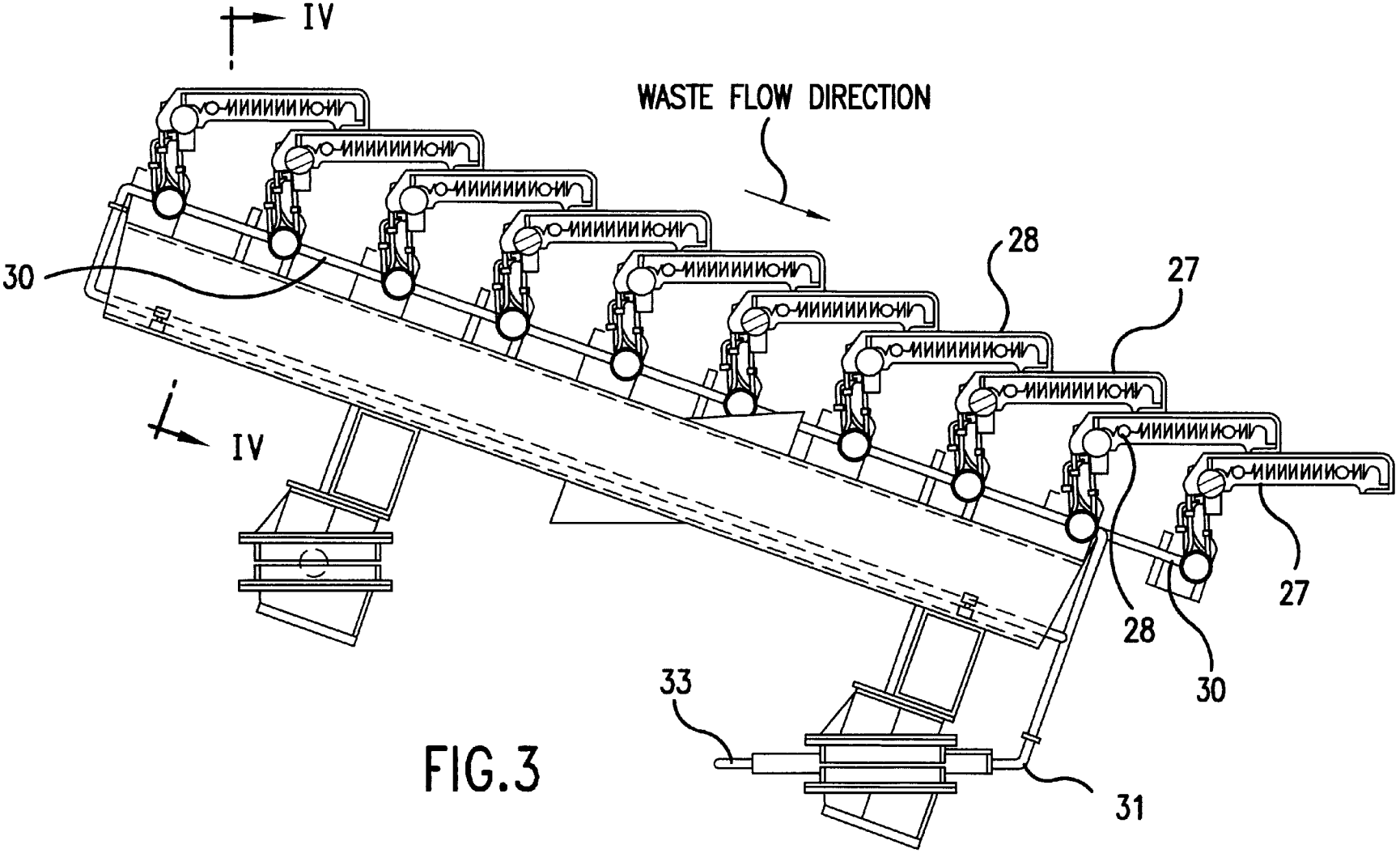
FIG. 3 is a view similar to FIG. 2 of a grate zone on an enlarged scale.

FIG. 3 shows on an enlarged scale a side view of a grate with fixed grate stages 27 and movable grate stages 28. Line 30 is used to feed the coolant into the fixed grate stages, while line 31 is used to feed coolant into movable grate stages 28. FIG. 3 likewise shows a feedwater cylinder 33 which takes into account the displacements of movable grate stages 28.

Figure 4:
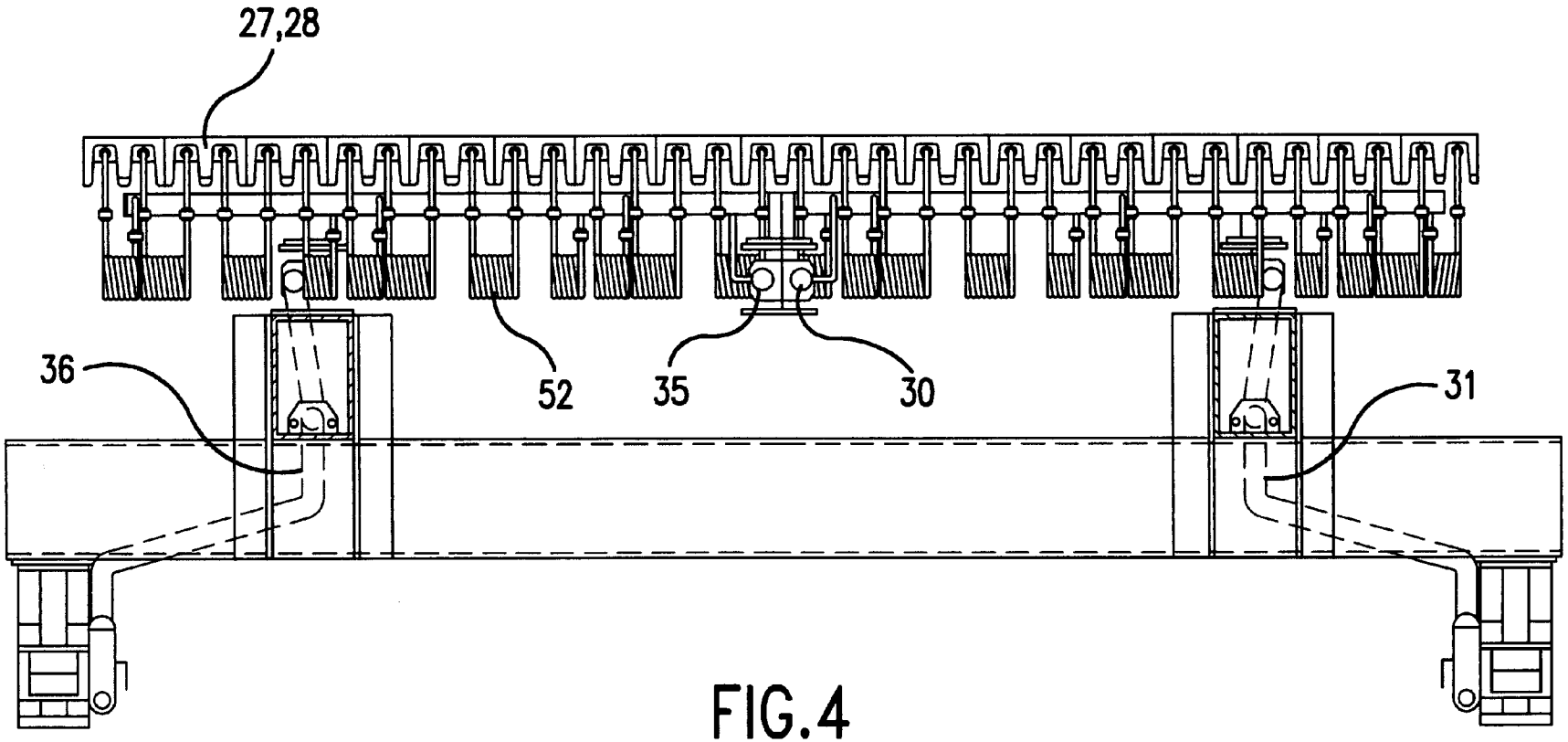
FIG. 4 is a sectional view along section line IV—IV of FIG. 3.

In FIG. 4, the two lines 30, 31 are likewise visible. In addition, the outflow lines 35, 36 for the through-flow medium are shown.

Figure 5:
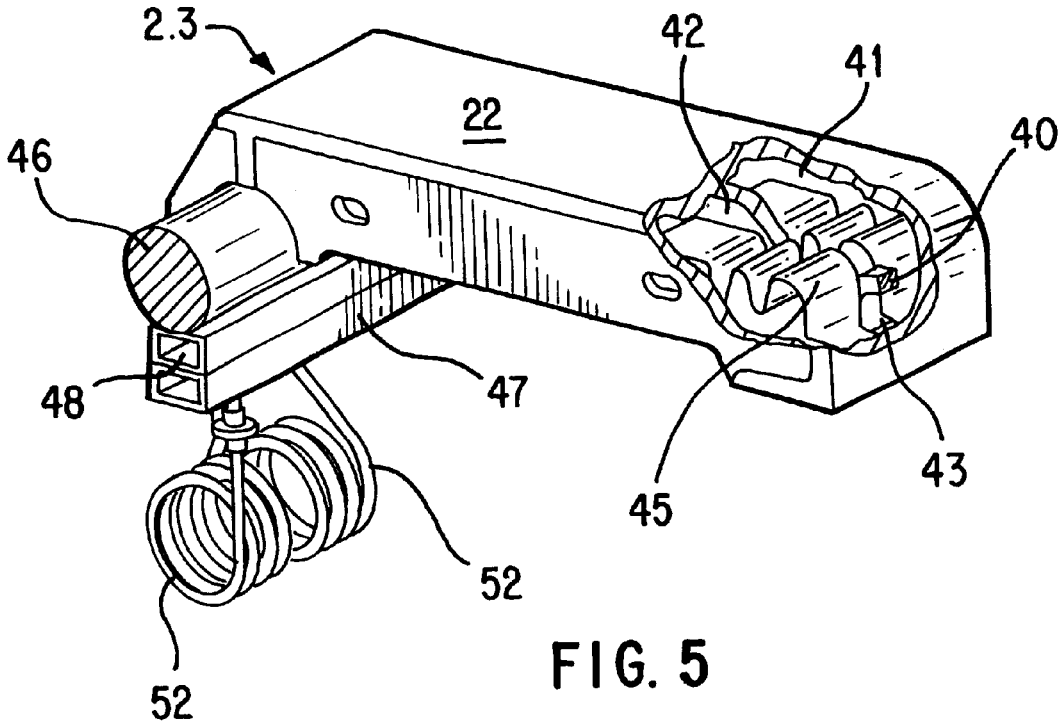
FIG. 5 is a perspective view of an air/water-cooled fire bar in a side view from the front, with parts cut away.
Figure 6:
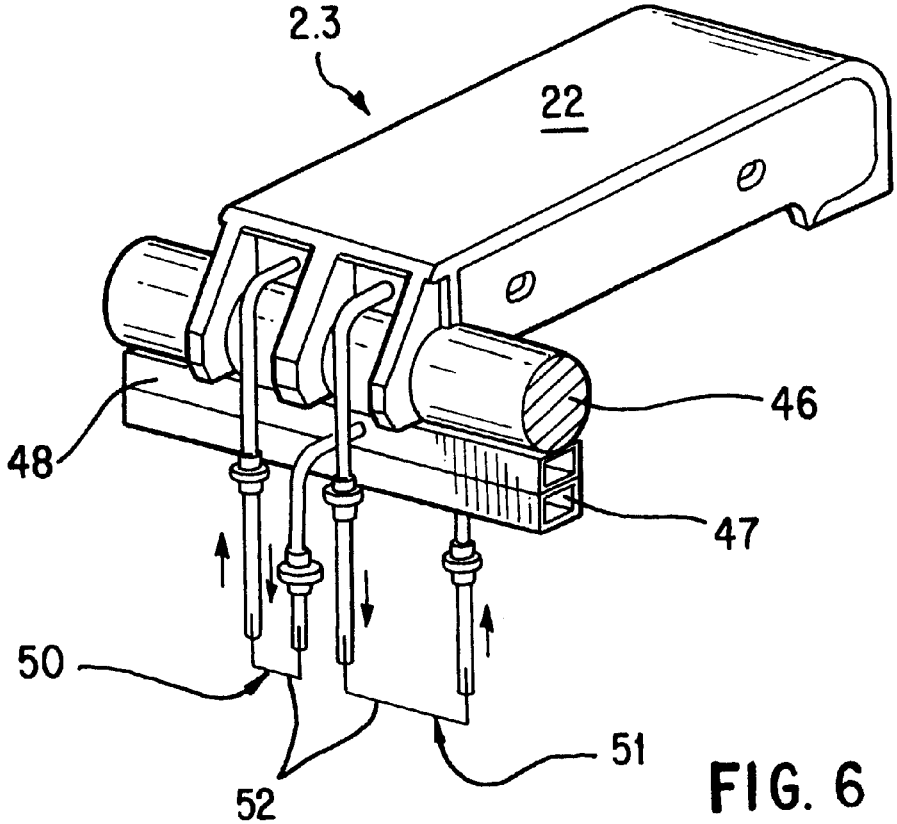
FIG. 6 is a perspective view of the air/water-cooled fire bar of FIG. 5 but in a side and rear view.

FIGS. 5 and 6 show, in a perspective view, details of a simplified configuration of an air/water-cooled fire bar. This can be a movable fire bar 2 or a fixed fire bar 3. This fire bar with grate surface 22 has a partition 40 in its interior so that, looking in the lengthwise direction, a first cooling chamber 41 and a second cooling chamber 42 parallel thereto result. At the forward end of fire bar 2 or 3, there is a water through-flow opening 43. This opening constitutes the link between the two cooling chambers 41, 42. In each of these cooling chambers, a corrugated exchanger or guide panel 45 is mounted parallel to partition 40 for improving the heat exchange.

Fire bars 2, 3 are pivotably mounted on a grate shaft 46. Immediately below grate shaft 46, a distributor 48 supports grate shaft 46, and below the distributor, a collector 47, in combination with cooling water supply line 50 and hot water return line 51, ensure the flow of the coolant through the fire bar.

As a result of the considerable temperature differentials that appear in the grate in the operating and nonoperating states, and as a result of the movements of fire bars 2, cooling water supply and return lines 50 and 51 are provided with turns like those of a coil spring, i.e. so-called temperature or thermal expansion compensating elements 52.

As a result of this arrangement, the cooling system is kept tight at the connections during both the resting and operating states.

Figure 7:
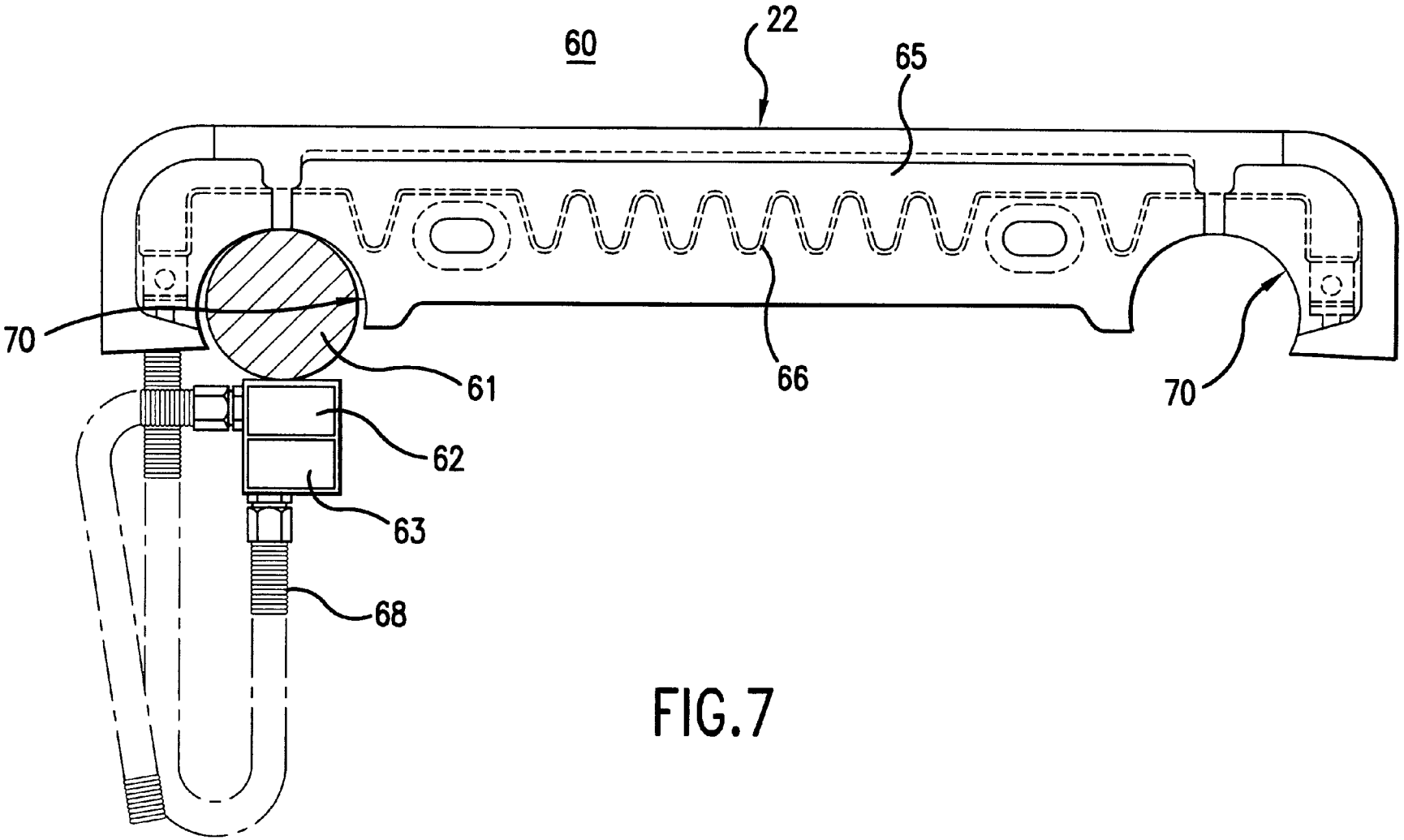
FIG. 7 is a rotating fire bar with side wall removed and metal hose connecting lines.

FIG. 7 shows a rotating fire bar or replaceable rod 60 pivotably mounted on a fire bar support 61. Below this fire bar support 61, a supporting coolant distributor 62 is combined with a collector 63. One cooling chamber 65 is equipped with a corrugated conducting panel 66. In this case, a connecting line 68 consisting of a metal hose is provided to ensure connections for the through-flow medium that are free of thermal stress.

Since this is a so-called rotating fire bar 60, a bearing shell 70 is likewise provided at its forward end so that, in the event of nonuniform wear of grate surface 22, the rotating fire bar 60 is rotated and forward bearing shell 70 can be placed on fire bar support 61. Corresponding connections and links are provided at the forward end of rotating fire bar 60, as can be seen.

With the system described and the regulating circuit provided, the air/water-cooled grate surface can be used to limit the influence of thermal overloads on the combustion grate locally or over the entire grate surface such that the known operating problems and wear of the grate surface can be largely eliminated. This is due to the air/water cooling of the grate surface, as shown and explained in FIG. 1. Cooling takes place as a function of the volume of cooling water and the temperature of the cooling water as well as the release of heat on the grate. For this purpose, as explained above, the temperature is regulated by a temperature sensor or a temperature-measuring system.

Another special feature of the invention consists in the fact that, when burning waste with a low heating value, the heat which is drawn from the liquid circuit into the fire bar, as a result of very intensive heat exchange between the fire bar and the combustion air because of the geometric shape of the fire bar, is given up to the combustion air. Thus, the combustion of the waste lying on the grate is accelerated.

When burning waste with a high heating value, a larger volume of heat is drawn from the corresponding grate parts by the coolant, whereas when burning waste with a low heating value, a lower heat value is carried away in the grate surface, which is used to warm up the combustion air to accelerate the combustion process in any case. The greater loss of heat to the combustion air and thus the increase in air temperature is achieved by reducing the volume of cooling water to a greater degree because of the lower loss of specific heat released in the combustion chamber than to the grate, and thus the temperature of the cooling water is increased to a greater degree. Consequently, an increased amount of heat is given up by the fire bar to the combustion air.

In this fashion, as a result of cooling, advantages are obtained for burning waste with a high heating value as well as waste with a low heating value, because the heat extracted from the combustion air can be supplied once again if necessary.

In this sense it is novel to separate the cooling function and the method function in a logical fashion and thus create a situation in which, with a change in the volume of combustion air below the grate (under-grate blast) which is due to the technology employed in the method, the effect of the cooling of the grate surface is influenced so that for the most part no problems can occur.

What is claimed is:

1. A combustion grate for transporting various fuels, said grate comprising fire bars configured to be cooled by a fluid medium, a regulating circuit and flow lines arranged to conduct the fluid medium, the flow lines being equipped with thermal expansion compensators configured as windings having a helical spring shape.

2. The combustion grate according to claim 1, wherein the fire bars include corrugated heat exchangers operatively connected with the flow lines.

3. The combustion grate according to claim 1, wherein the fire bars are configured as replaceable rods.

4. The combustion grate according to claim 3, wherein the fire bars include corrugated heat exchangers operatively connected with the flow lines.

5. The combustion grate according to claim 1, wherein the regulating circuit is a closed circuit.

6. The combustion grate according to claim 5, wherein the fire bars include corrugated heat exchangers.

7. The combustion grate according to claim 6, wherein the fire bars are configured as replaceable rods.

8. The combustion grate according to claim 1, wherein the regulating circuit is configured to have control parameters that include at least one of the through-flow volume of cooling fluid per unit time and the cooling fluid temperature.

9. The combustion grate according to claim 8, wherein the fire bars include corrugated heat exchangers operatively connected with the flow lines.

10. The combustion grate according to claim 9, wherein the fire bars are configured as replaceable rods.

11. The combustion grate according to claim 10, wherein the regulating circuit is a closed circuit.

12. The combustion grate according to claim 1, wherein the regulating circuit comprises at least one coolant heat exchanger and a combustion air heat exchanger.

13. The combustion grate according to claim 12, wherein the fire bars include corrugated heat exchangers operatively connected with the flow lines.

14. The combustion grate according to claim 13, wherein the fire bars are configured as replaceable rods.

15. The combustion grate according to claim 14, wherein the regulating circuit is a closed circuit.

16. The combustion grate according to claim 15, wherein the regulating circuit is configured to have control parameters that include at least one of the through-flow volume of cooling fluid per unit time and the cooling fluid temperature.

17. The combustion grate according to claim 1, wherein the regulating circuit includes a bypass.

18. The combustion grate according to claim 17, wherein the fire bars include corrugated heat exchangers.

19. The combustion grate according to claim 18, wherein the fire bars are configured as replaceable rods.

20. The combustion grate according to claim 19, wherein the regulating circuit is a closed circuit.

21. A combustion grate for transporting various fuels, said grate being at least partially gas-cooled and liquid-cooled via a regulating circuit, said grate further comprising grate bars and also comprising pipes operatively connected with the grate bars, the pipes being configured for feeding and removal of liquid coolant to the grate bars, the pipes also being equipped with thermal expansion compensators configured as helical coil-spring-shaped windings.

22. The combustion grate according to claim 21, wherein the grate bars include corrugated heat exchangers.

23. The combustion grate according to claim 21, wherein the grate bars are replaceable rods.

24. The combustion grate according to claim 23, wherein the rods include corrugated heat exchangers.

* * * * *